US006928679B1

(12) United States Patent
Gross

(10) Patent No.: US 6,928,679 B1
(45) Date of Patent: Aug. 16, 2005

(54) HEAD SUPPORT WITH BED EXTENSION

(76) Inventor: Steven J. Gross, 1116 Pottstown Pike, West Chester, PA (US) 19380

( * ) Notice: Subject to any disclaimer, the term of this patent is extended or adjusted under 35 U.S.C. 154(b) by 0 days.

(21) Appl. No.: 10/764,671

(22) Filed: Jan. 26, 2004

(51) Int. Cl.[7] ..... A47C 20/02
(52) U.S. Cl. ..... 5/638; 5/640; 5/643
(58) Field of Search ..... 5/636–638, 640, 5/643, 725

(56) References Cited

U.S. PATENT DOCUMENTS

| | | | | |
|---|---|---|---|---|
| 2,239,003 | A * | 4/1941 | Jones | 5/638 |
| 4,752,064 | A * | 6/1988 | Voss | 5/638 |
| 4,757,983 | A | 7/1988 | Ray et al. | 269/328 |
| 4,881,728 | A | 11/1989 | Hunter | 269/328 |
| 4,943,041 | A | 7/1990 | Romein | 269/322 |
| 5,177,823 | A | 1/1993 | Riach | 5/636 |
| 5,652,981 | A * | 8/1997 | Singer-Leyton et al. | 5/631 |
| 5,778,887 | A * | 7/1998 | Curtiss | 5/638 |
| 5,970,546 | A * | 10/1999 | Danis | 5/636 |
| 6,039,704 | A | 3/2000 | Domenighini et al. | 601/79 |
| 6,042,184 | A * | 3/2000 | Kofoed | 5/638 |
| 6,148,460 | A | 11/2000 | Fried et al. | 5/661 |
| 6,151,734 | A | 11/2000 | Lawrie | 5/640 |
| 6,182,313 | B1 * | 2/2001 | Eschenbach | 5/640 |
| 6,397,414 | B1 | 6/2002 | Lloyd | 5/622 |
| 6,412,127 | B1 * | 7/2002 | Cuddy | 5/632 |
| 2002/0096929 | A1 | 7/2002 | Showerman | 297/423.12 |

* cited by examiner

*Primary Examiner*—Frederick L. Lagman
(74) *Attorney, Agent, or Firm*—Michael F. Petock Esq; Petock & Petock LLC

(57) ABSTRACT

A first and second substantially crescent shaped rigid support are provided with substantially crescent shaped pads mounted thereon. A strap is mounted at each end of the supports for holding the supports together at a preselected distance. The supports may be used on a flat surface such as a floor or may be mounted on an independently positioned pair of rails for mounting between a mattress and a box spring by means of posts which are removably received in an opening in the crescent shaped supports and adjustably locked in an opening in each rail. The head support may be utilized on a flat surface such as a floor or beach, or as an extension for a bed for use in the giving of massages. The head support of the present invention may be used on a penetrable surface such as a sandy beach with use of the posts.

18 Claims, 5 Drawing Sheets

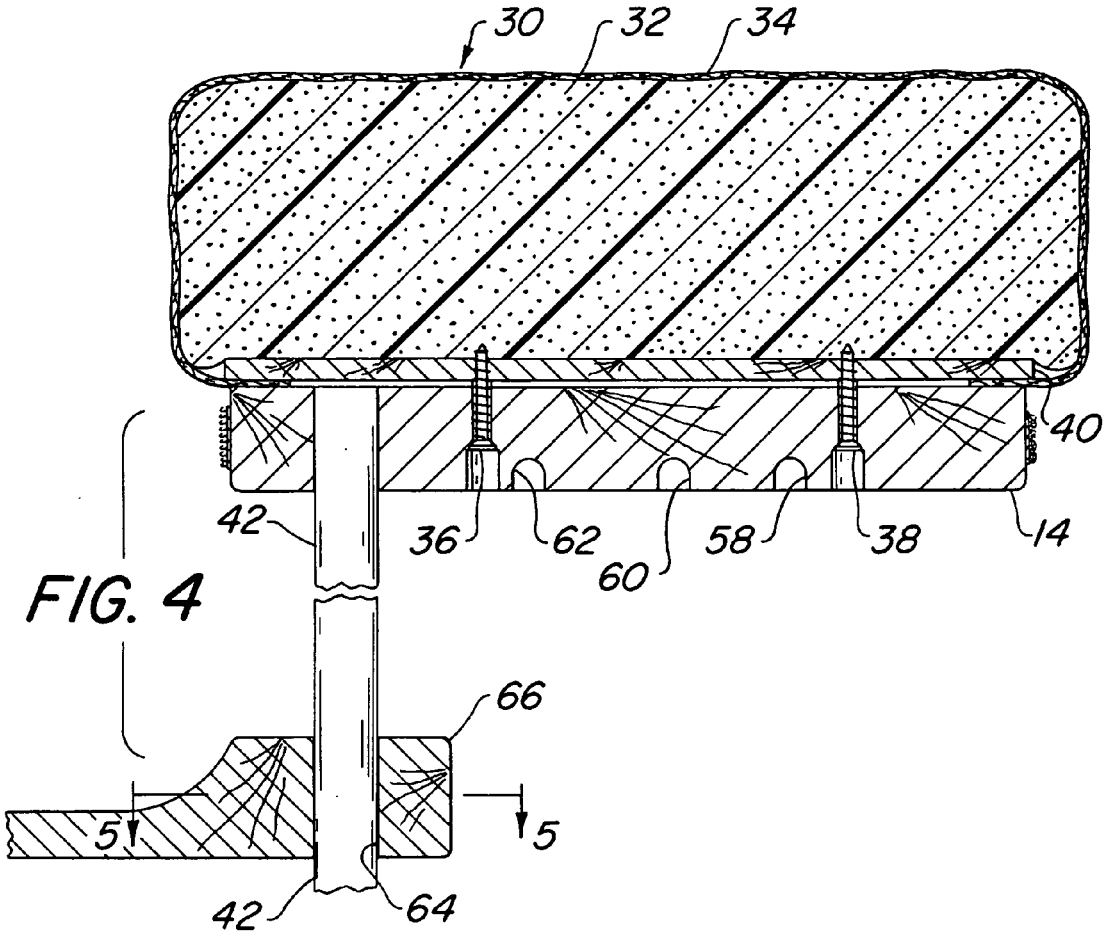
FIG. 4
FIG. 5
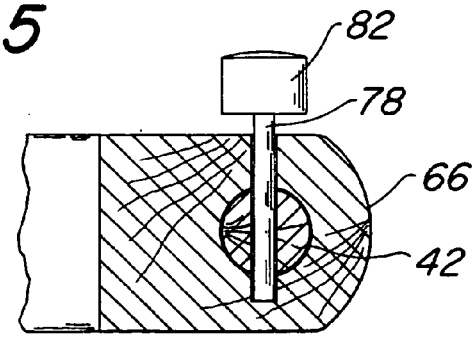

HEAD SUPPORT WITH BED EXTENSION

FIELD OF THE INVENTION

The present invention relates to a head support which may also function as a bed extension. More particularly, the present invention relates to a head support which may also function as a bed extension for massage and other uses, and which may also be utilized on a floor, beach or other flat surface. The present invention includes independently mounted substantially crescent shaped pads with adjustability of the distance between the pads.

BACKGROUND OF THE INVENTION

The giving of massages for therapeutic and non therapeutic purposes is quite popular and there is a need for the ability to support the head in both the prone and the supine positions whether on a bed or on a flat surface such as a floor. Further, persons or users receiving massages are of different sizes.

A fair amount of effort has been devoted to providing various types of head supports for use in the giving of massages. For example, U.S. Pat. No. 6,182,313 B1—Eschenbach discloses a pair of spaced apart tubular members connected by a threaded tubular member therebetween to form a U-shaped structure wherein the parallel support members have a dual density foam covering. The spacing between the tubular support members may be adjusted by means of the rotation on the threads on the tubular member connecting the two support members. Eschenbach requires a large U-shaped tubular structure which is difficult to adjust with respect to spacing. The U-shaped structure inhibits airflow. Further, there is no provision of any structure for mounting the U-shaped structure in a manner to act as a face or head extension on a mattress.

U.S. Pat. No. 6,151,734—Lawrie discloses a face plate which may be horseshoe, U-shaped or circular shaped on which a cushion is mounted. The face plate is connected to a base plate which may be mounted between a mattress and a box spring. The supporting legs are fixedly mounted to the base plate 16. Again, this provides a U-shaped or horseshoe shaped arrangement for support of the head and is not adjustable. The only adjustability that is provided is for the height of the mattress, and this adjustability is limited by the arrangement of the legs with respect to the base plate.

U.S. Pat. No. 6,148,460—Fried et al. discloses a bed extension device having a U-shaped cushion mounted on a head support element with a hole in the center supported by a pole on a horizontal member that mounts between a mattress and a box spring. There is no adjustability of the sides of the U-shaped cushion and the head support element is mounted fixedly to the horizontal member except for adjustability with respect to the height of the mattress.

Improvement in this area would be desirable to provide enhanced adjustability and improved structural arrangement.

SUMMARY OF THE INVENTION

An advantage of the present invention is that it provides ease of adjustment of the spacing between the head support pads for supporting either the face or the back of the head.

Another advantage of the present invention is that the head support apparatus of the present invention may be utilized on a floor or other flat surface or as a bed extension.

Another advantage of the present invention is that it provides sufficient and adequate unrestricted airflow since both the forward and rearward ends between the crescent shaped supports are open.

Another advantage of the present invention is that the crescent shaped supports provide a comfortable support for the head.

Another advantage of the present invention is that it provides significant adjustability not only in spacing between the crescent shaped supports, but also with respect to the height adjustment where the supports are supported by skies or rails positioned between a mattress and a box spring.

Another advantage of the present invention is that it provides airway openings in the rigid support under the crescent shaped pads for increased breathable airflow to the person using the head support.

Briefly and basically, in accordance with the present invention, a head support is provided which comprises a first and a second substantially crescent shaped rigid support with each rigid support having a first end and a second end. A substantially crescent shaped pad is mounted to each of the first and second substantially crescent shaped rigid supports. A strap adjustably mounted at each end of the substantially crescent shaped supports holds said supports together at a preselected distance and the supports may be placed on a substantially flat surface for supporting a head of a user lying on the substantially flat surface, such as a floor.

In one presently preferred embodiment, each of the substantially crescent shaped rigid supports may be provided with at least one opening for airflow for enhancing airflow where the head support is used on a substantially flat surface, such as a floor. In one presently preferred embodiment, each support would be provided with three openings in the form of bore or tubular openings for airflow. Further, airflow may be enhanced by slanting the bore or tubular opening to aid airflow by convection. Also, in a presently preferred embodiment, the strap may be adjustable in length by use of a hook and loop fastener, such as those sold under the trademark VELCRO.

Further, in accordance with one embodiment of the present invention, the head support may further include a first and a second rail, the first and second rail each having an elongated portion adapted to be positioned independently between a mattress and a box spring, each of the support rails having an opening near an end opposite the elongated portion. A first and second post is adapted to be received in the opening in the first and second rail, respectively. Means for adjustably locking the position of the first post with respect to the first rail and the position of the second post with respect to the second rail is provided. Each of the first and second substantially crescent shaped rigid supports is provided with an opening for removably receiving an upper end of the first and second posts, respectively. In this manner, the head support may be mounted by use of the support rails being positioned between a mattress and a box spring with the head support acting as an extension of the bed, with complete adjustability of the spacing between the substantially crescent shaped support pads and rails and complete adjustability with respect to height.

Additionally, or alternatively, the head support of the present invention may be used on a substantially flat penetrable surface, such as a sandy beach, without the use of the skis or rails wherein the posts are forced into the sand or other penetrable surface. In this manner, with the post inserted into the sand and at least one of the straps applied, the head support may be used in the prone or the supine position.

Additionally, or alternatively, in another embodiment of the present invention, telescoping posts may be utilized in connection with the rails to adjust the height of the substantially crescent shaped pads above the rails, and may be locked in the adjusted height position by various means.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 4 is a partially broken away cross sectional view taken along line 4—4 of FIG. 3.

FIG. 5 is a partially broken away cross sectional view taken along line 5—5 of FIG. 4.

DETAILED DESCRIPTION OF THE PREFERRED EMBODIMENTS

Figure 1:
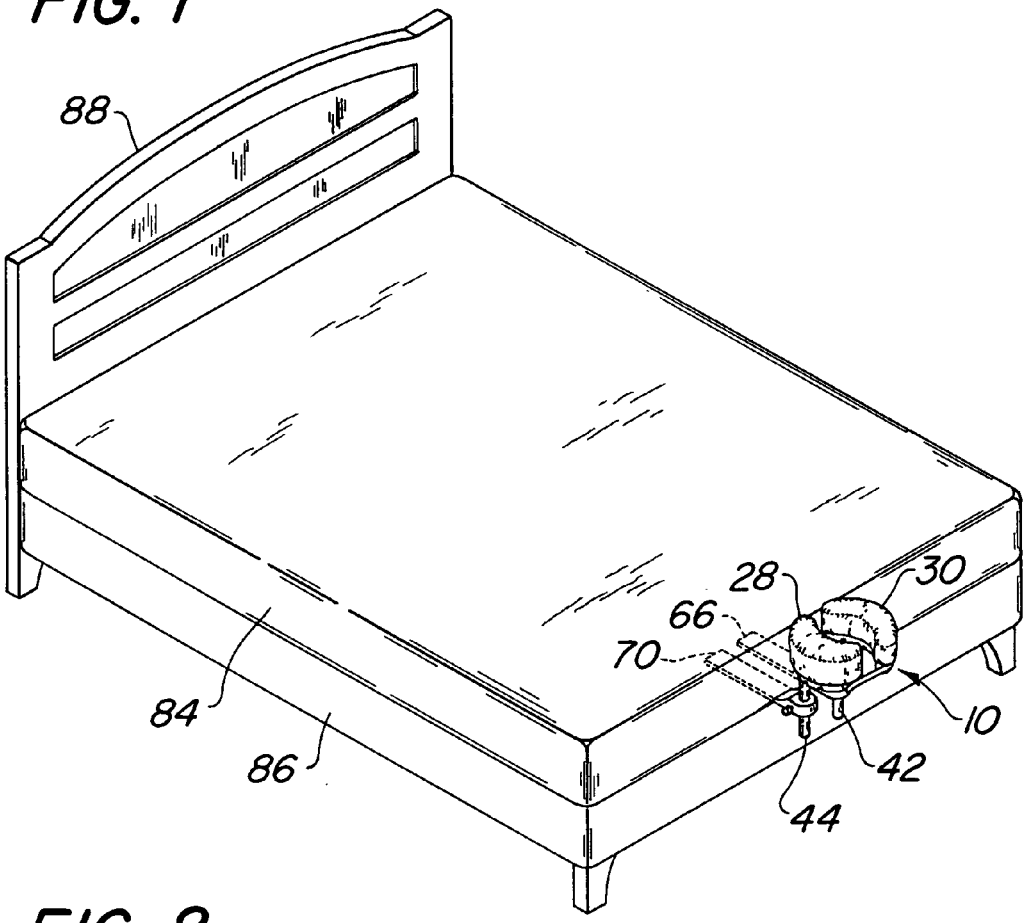
FIG. 1 is a view in perspective of an apparatus in accordance with the present invention used as a bed extension head support for massage.

Referring now to the drawings, wherein like numerals indicate like elements, there is shown in FIG. 1 a bed extension head support for massage 10. Although the use of the present invention is often identified as being for massage, it is understood that various other uses may be made of the present invention including such uses as a head support on a beach where the supporting post to be discussed hereinafter may be inserted into the sand. The bed extension head support 10 of FIG. 1 should be viewed in conjunction with the more detailed illustration shown in FIG. 3. Bed extension head support 10 is comprised of a first substantially crescent shaped rigid support 12 and a second substantially crescent shaped rigid support 14. Crescent shaped generally means the shape of the moon as it appears in the first or last quarter, with concave and convex edges terminating in points. However, here substantially crescent shaped means that the ends are rounded as illustrated in the drawings. Further, the concave and convex curvatures may vary somewhat. However, the substantially crescent shaped rigid supports 12 and 14 and the pads 28 and 30 to be discussed hereinafter provide comfortable support for the face or the back of the head of a person receiving a massage. Further, the support of the present invention is provided by two independent rigid supports with pads mounted thereon.

Substantially crescent shaped rigid support 12 is provided with strap attachments at each end 16 and 18. Similarly, substantially crescent shaped rigid support 14 is provided with strap attachments at it ends 20 and 22. Preferably, straps 24 and 26 are adjustably attached to the ends of the substantially crescent shaped rigid supports 12 and 14 by hook and loop fasteners such as VELCRO, although any other type of suitable straps adapted to provide adjustable spacing of rigid supports 12 and 14 may be utilized. Straps 24 and 26 are utilized to hold the crescent shaped rigid support members 12 and 14 together at a preselected distance. In other words, this adjustment may be made to adjust for comfortable use by persons of different size heads and for the most comfortable position as desired by persons of the same head size.

A substantially crescent shaped pad 28 is mounted on substantially crescent shaped rigid support 12. A similarly shaped pad 30 is mounted-on rigid support 14. As may be seen in FIG. 4, pad 30, and substantially identical pad 28, may be comprised of a foam material 32 provided with a suitable cover 34. Cover 34 may be any suitable material including leather, vinyl, cloth or synthetic fabrics or synthetic materials. Pad 34 may be suitably bonded to rigid support 14 by any suitable manner included threaded fasteners such as screws 36 and 38 mounted into a plate 40 within pad 30, or by adhesive or any suitable means. Rigid supports 12 and 14 and plate 40 may be made of wood or any other suitable material including synthetic plastic. In a presently preferred embodiment, rigid support members 12 and 14 and plate 40 are constructed of wood, but other suitable materials may be utilized.

Figure 3:
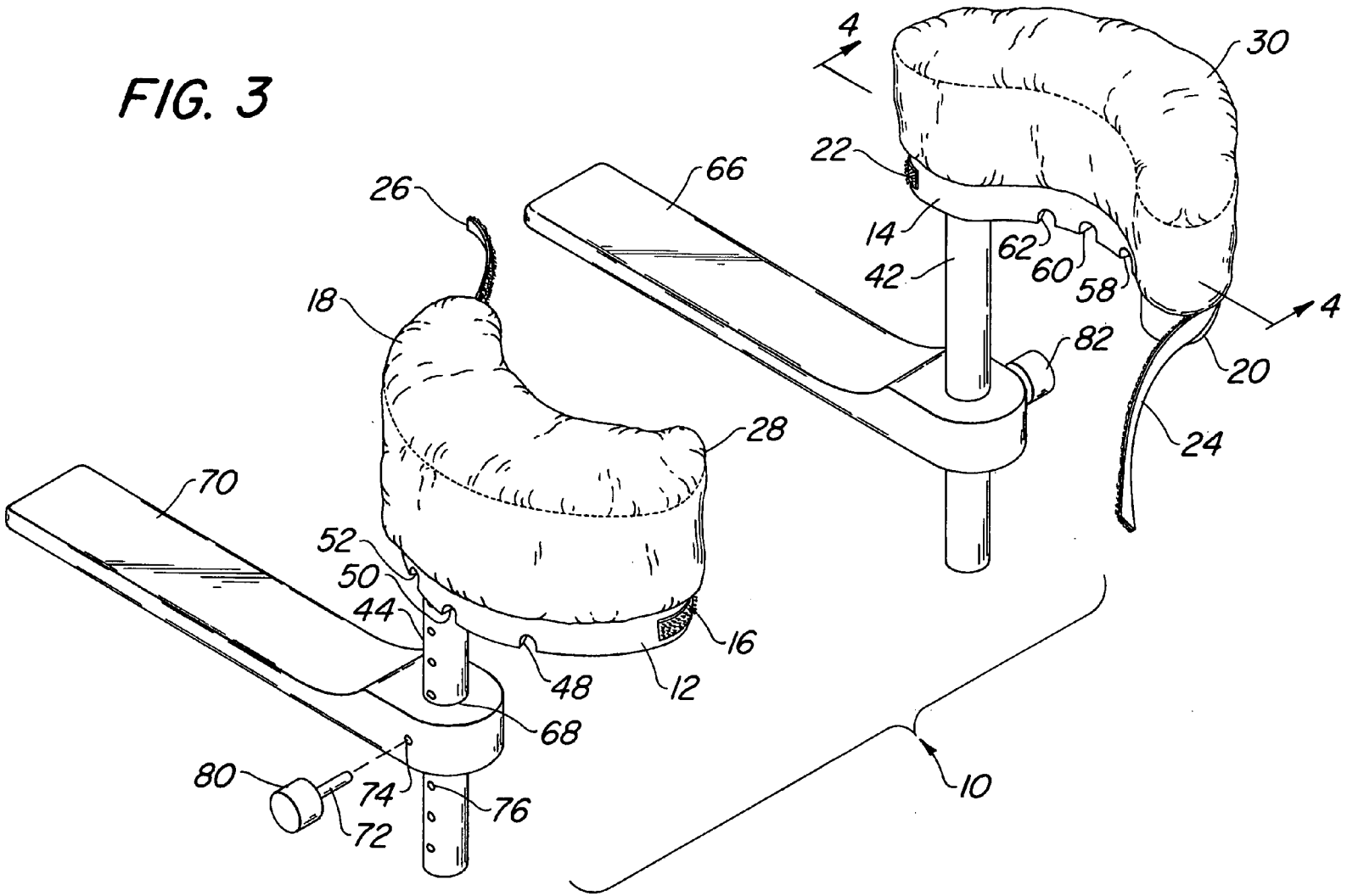
FIG. 3 is an enlarged view of the apparatus shown in FIG. 1 which may be used as a bed extension head support for massage.

Continuing to refer now to FIGS. 3 and 4, rigid support 14 is removably mounted on post 42. Rigid support 14 may be removably mounted on post 42 by various suitable means, but a presently preferred embodiment utilizes a hole formed in rigid support 14 into which post 42 may be inserted. In a similar manner, rigid support 12 is removably mounted on post 44.

Figure 2:
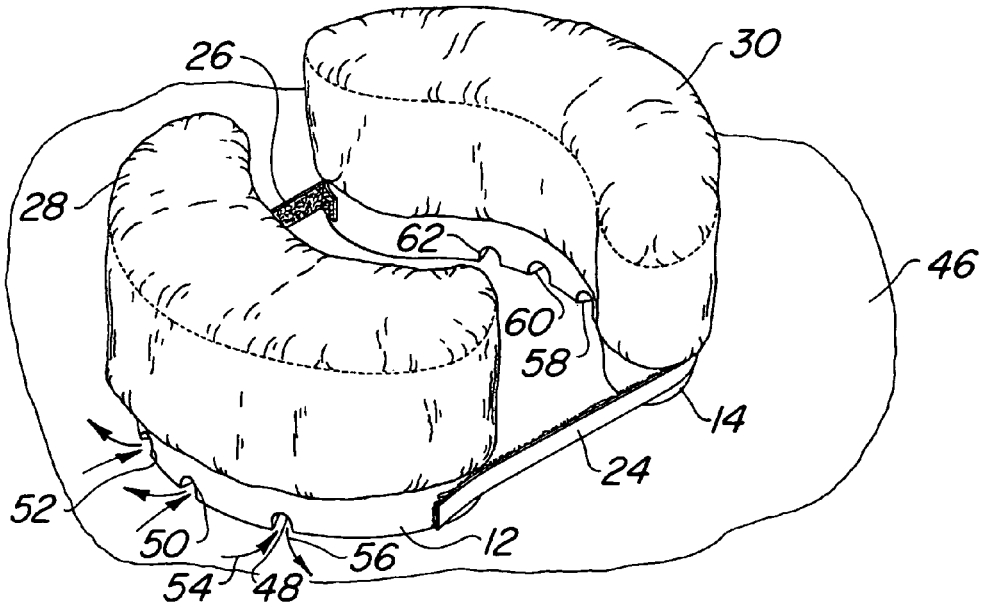
FIG. 2 is a view in perspective of a head support apparatus for massage used on a flat surface such as a floor.

As illustrated in FIG. 2, rigid supports 12 and 14, which are mirror images of each other, may be removed from supporting posts 42 and 44 and utilized on a flat surface such as a floor as illustrated in FIG. 2. Referring to FIG. 2, rigid supports 12 and 14 are held apart at a preselected distance by adjustable straps 24 and 26. In this manner, pads 28 and 30 may be provided at a preselected or desired distance apart to provide the most comfortable support for the face or back of the head, or other portion of the head, of a person receiving a massage on a flat surface such as a floor 46. Substantially crescent rigid support 12 is provided with openings 48, 50 and 52 on its lower surface allowing for airflow to ingress to and egress from the space between the rigid supports 12 and 14 and pads 28 and 30. Air ingress is shown by arrow 54 and air egress is shown by arrow 56. Similar openings 58, 60 and 62 are provided on substantially crescent shaped rigid support member 14.

Referring now to FIGS. 1, 3, 4 and 5, post 42 is mounted in opening 64 in rail or ski 66. Similarly, post 44 is mounted in opening 68 in rail or ski 70. As illustrated in FIG. 3, the outer sides of posts 42 and 44 are provided with openings 76 for receiving of a pin for the positioning or height adjustment of the pads with respect to the top of the mattress when the apparatus is utilized as illustrated in FIG. 1. The placement of the holes and pins on the outer side of the posts and skis or rails enables the skis or rails to be brought closer together allowing for increased adjustability of the distance between them. As illustrated, in FIG. 3, openings 76 may be provided a preselected distance apart, such as ½ inch apart and the height of the post may be adjusted by inserting a pin 72 through opening 74 in rail 70 and into one of the holes 76 in post 44. The spacing between pin opening 76 may be any suitable desired distance, for example, ⅜ inch or ⅝ inch. As illustrated in FIG. 5, post 42 is provided with a similar pin 78 which passes through rail 66 and into an opening or hole in post 42. As illustrated in FIG. 5, it is preferable that pin 78 go completely through post 42 and partially into the other side of ski or rail 66. This is particularly the case where the support apparatus of the present invention may be constructed of plastic. However, it is understood that pin 78 may go through one side of rail 66 and only partially into post 42, and this arrangement would be particularly sufficient where the supporting material is made of a fairly rigid material such as wood or metal. Pin 72 may be provided with a knob or handle 80 and pin 78 may be provided with a knob or handle 82 for ease of insertion and removal of the pins. Posts 42 and 44 pass completely through ski or rails 66 and 70, respectively, enabling a full range of adjustment of the height of pads 28 and 30 with respect to the upper surface of mattress 84. This is of particular significance today in view of the wide variation in the height of mattresses.

Figure 6:
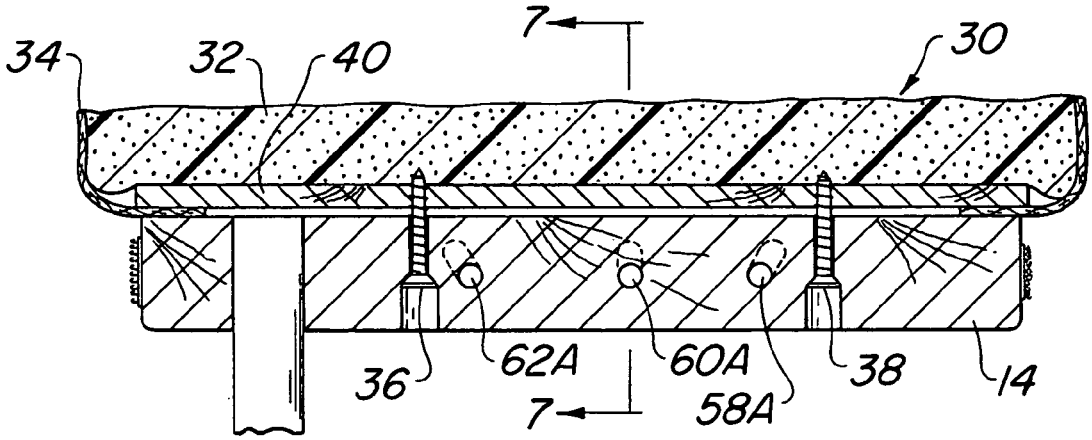
FIG. 6 is a partially broken away cross sectional view, corresponding to a portion of FIG. 4, of another embodiment of the present invention.
Figure 7:
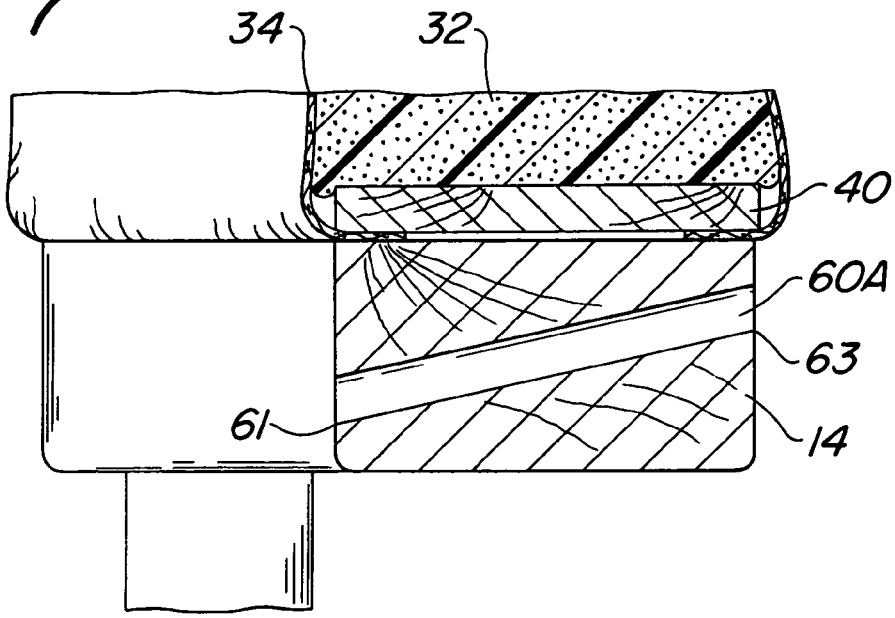
FIG. 7 is a partially broken away cross sectional view taken along line 7—7 of FIG. 6.

FIGS. 6 and 7 represent a presently preferred embodiment where the air openings in rigid supports 12 and 14 are in the form of bore holes or tubular openings passing through the body of rigid supports 12 and 14. As illustrated in FIG. 6, air openings 58A, 60A and 62A are in the form of tubular openings which pass through the body of rigid support 14, and rigid support 12 not shown. Tubular openings 58A, 60A and 62A are a predetermined distance from the bottom of rigid support 14, and thereby will not be blocked by carpeting, such as shag carpeting, when used in that manner. Further, when used on the beach, sand would not block the air openings.

As illustrated in FIG. 7, the air openings 58A, 60A and 62A may slope upwardly from the inside to the outside of the rigid support. As illustrated in FIG. 7, opening 60A starts a predetermined distance from the bottom of rigid support 14, perhaps a ¼ inch or ⅜ inch as illustrated as 61. Tubular opening 60A slopes upwardly and ends at 63 on the outer surface of rigid support 14. In this manner, heated airflow from the central area between pads 28 and 30, where the air is heated by the breathing out of the person receiving the massage or using the head support would tend to flow upwardly aided by convection and exit at a higher level at exit 63. Cooler air from the outside would also tend to flow down tubular opening 60A exiting at 61 in the area of the nose and face of the person using the head support. In this manner convection aids both the outflow of heated air and the inflow of cooler air.

In use, as illustrated in FIG. 1, rails 66 and 70 may be inserted between mattress 84 and box spring 86 of a bed. This may be mounted at any accessible point between the mattress and the box spring, but in many cases it would be preferable to insert it between the mattress and the box spring along the foot of the bed, opposite head board 88. In this manner, a person may lie face down in the prone position or face up in the supine position, resting their head on head rest 10. Of course, head rest 10 provides its most usefulness when the person is lying in the prone position as the person is able to lay flat on the mattress with their face supported by pads 28 and 30 and still breathe properly.

In accordance with the present invention, substantially crescent shaped rigid support members 12 and 14 along with their corresponding substantially crescent shaped pads 28 and 30 are independently mounted on their respective rails or skis 70 and 66. This allows for unlimited adjustment of the spacing between pads 28 and 30 and also allows for unrestricted airflow at both ends of the substantially crescent shaped rigid supports and pads. The rigid supports 12 and 14, along with their corresponding pads, are held a preselected distance apart by the adjustable straps 24 and 26. Each substantially crescent shaped rigid support may be mounted on a flat surface such as a floor as illustrated in FIG. 2 where airflow is provided at both ends of the rigid supports and pads as well as by the openings 48, 50 and 52 and 58, 60 and 62 in the rigid supports. Although three air openings are shown in each of the rigid supports 12 and 14, it is understood that more or less openings may be utilized to provide airflow as desired. The head massage support of the present invention is not a closed structure nor a U-shaped structure which inhibits airflow and precludes adjustability of the spacing between the supporting pads.

Alternatively, the present invention without the use of the skis or rails 66 and 70 may be utilized on any substantially flat penetrable surface, such as a sandy beach. Any of the embodiments may be used on such a surface by forcing the posts 42 and 44 into the surface, such as a sandy beach, at an appropriate spaced distance and using at least strap 26 to hold the distal ends of crescent shaped rigid supports at a predetermined distance. In this manner, the head support of the present invention may be utilized on such a penetrable surface in either the prone or the supine position. The head support of the present invention may be used on a penetrable surface such as a sandy beach with or without use of the posts.

The rigid supports 12 and 14, the posts 42 and 44 and the rails or skis 66 and 70 may be made of any suitable fairly rigid material including wood, plastic, metal or any other suitable fairly rigid material. Various foam materials or other cushion materials may be utilized to provide the padding 32. Various suitable covering materials may be utilized as the cover 34, including leather, vinyl, various fabrics and other suitable materials.

Figure 8:
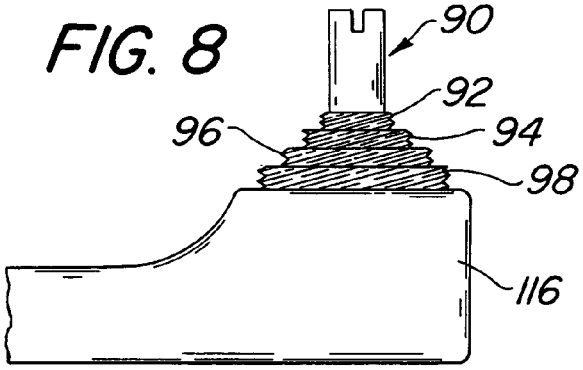
FIG. 8 is an elevation view, partially broken away, of another embodiment of the present invention illustrating a telescoping post which is threadably adjustable.
Figure 9:
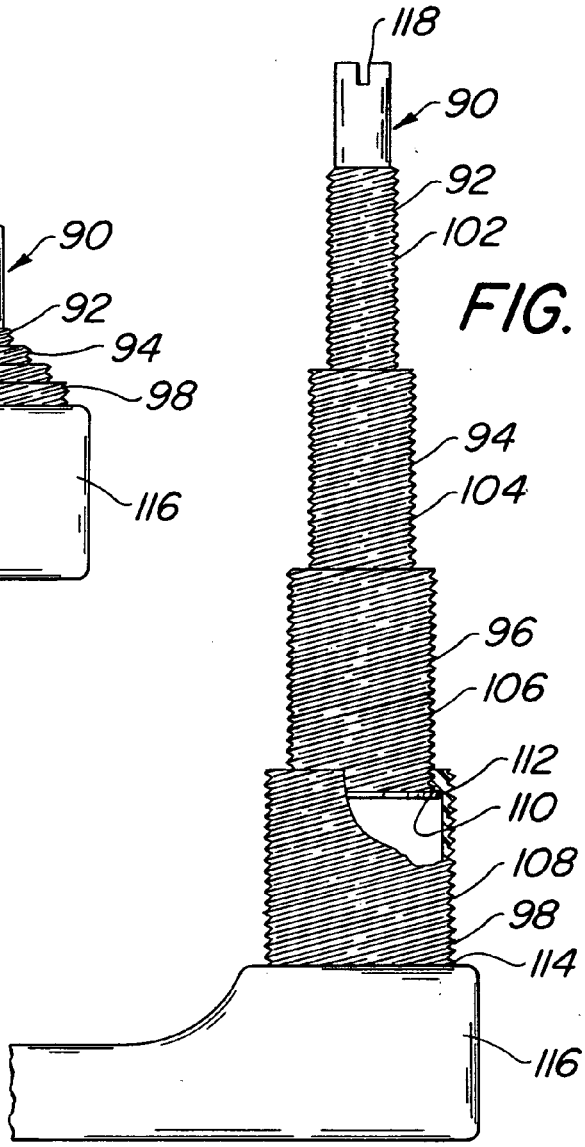
FIG. 9 is an elevation view, partially broken away, of the embodiment of FIG. 8 with the telescoping post in its extended position.
Figure 10:
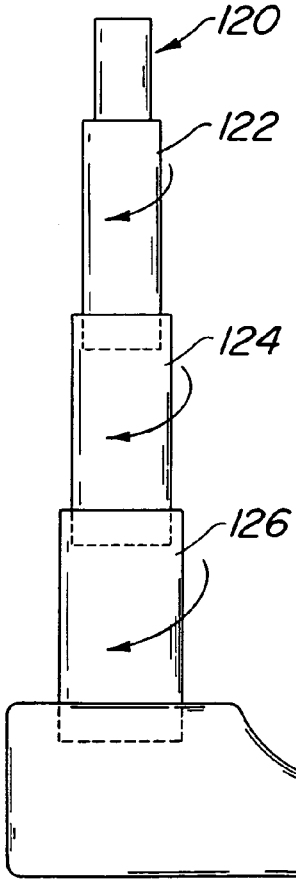
FIG. 10 is an elevation view, partially broken away, of another embodiment of the present invention utilizing a telescoping post with friction lock means.

Referring now to FIGS. 8, 9 and 10, there are shown additional embodiments of the invention which utilize adjustable height posts in the form of telescoping posts. These may be preferably permanently attached to the skis or rails, but may be removeably attached. FIGS. 8 and 9 illustrate a telescoping post 90 which is threadably adjustable, FIG. 8 illustrates the telescoping post in its contracted position and FIG. 9 illustrates the post in its extended position. Telescoping post 90 is comprised of telescoping sections 92, 94, 96 and 98. Each of the sections 92, 94, 96 and 98 is provided with threads 102, 104, 106 and 108, respectively, which mate with internal threads of the adjacent section, such as those illustrated at 110 on section 98. Each of the telescoping sections 92, 94, 96 and 98 may preferably be provided with a stop 112 to prevent the upper section from being threaded out of an adjacent lower section.

Telescoping post 90 is mounted at a first end 114 into a first end of ski or rail 116. Ski or rail 116 is similar in structure to ski or rails 66 and 70 except that post 90 does not pass through an opening in the ski or rail 116. Ski or rail 116 has a second end (not shown) which may be inserted between a box spring and a mattress or directly under an air mattress, futon or conventional mattress directly on the floor.

In operation, ski or rail 116 may be mounted between two layers, such as a mattress and box spring, or may be placed on a flat surface such as a floor or beach and the height of post 90 may be adjusted by turning the sections of post 90. This may be done by manually grabbing the upper end or second end of post 90 or may be accomplished by use of a screwdriver type tool in slot 118. It is understood that there would be two skis such as 116 with each having a telescoping post 90 and this combined structure would be used in a manner similar to that as described for the other embodiments. Once the post is adjusted to the proper height, substantially crescent shaped rigid supports 12 and 14 with their associated padding may be mounted on the upper or second end of post 90. If the head support of the present invention is to be used on a flat surface such as a floor, post 90 would be adjusted to a contracted length similar to that shown in FIG. 8. If the head support of the present invention is to be used in connection with a mattress of substantial height, the length of post 90 would be adjusted similar to that as shown in FIG. 9. It is understood that post 90 may be adjusted to any suitable length as desired by the user within the limits of fully contracted post 90 to a fully extended post 90.

There is shown an alternate embodiment of a telescoping post 120 in FIG. 10. FIG. 10 illustrates post 120 comprised of telescoping sections 122, 124 and 126. It is understood that more or less than three telescoping sections may be utilized. Similarly, with respect to FIGS. 8 and 9, more or less than four telescoping sections may be utilized. In FIG. 10, telescoping sections are locked together by suitable friction lock engagement wherein the sections may be locked together at a particular height adjustment or freed for slidable movement by a partial turn of one of the sections with respect to its mating section, such as by a quarter or half rotation. In other words, by twisting one section, for example section 122 with respect to section 124 by a quarter of a turn in one direction, section 122 is locked to section 124 at whatever position that two sections have with respect to each other. Similarly, a quarter rotation turn in the opposite direction frees section 122 to slide freely with respect to 124 and will allow section 122 to go substantially completely into section 124.

The present invention may be embodied in other specific forms without departing from the spirit or essential attributes thereof and, accordingly, reference should be made to the appended claims, rather than to the foregoing specification as indicating the scope of the invention.

I claim:

1. A head support, comprising:

a first and a second substantially crescent shaped rigid support, each rigid support having a first end and a second end;

a substantially crescent shaped pad mounted on each of said first and second substantially crescent shaped rigid supports;

a strap adjustably mounted at each end of each of said substantially crescent shaped supports for holding said supports together at a preselected distance; and whereby said supports may be placed on a substantially flat surface for supporting a head of a user lying on the substantially flat surface.

2. A head support in accordance with claim 1 wherein each of said supports is provided with at least one opening for airflow.

3. A head support in accordance with claim 1 wherein each of said supports is provided with three openings in the form of channels for airflow.

4. A head support in accordance with claim 1 wherein each said strap is adjustable in length by a hook and loop fastener.

5. A head support in accordance with claim 1 further including:

a first and a second rail, said first and second rail each having an elongated portion adapted to be positioned independently between a mattress and a box spring, each of said first and second support rails having an opening near an end opposite said elongated portion;

a first and a second post adapted to be received in the opening in said first and second rail, respectively;

means for adjustably locking the position of said first post with respect to said first rail and the position of said second post with respect to said second rail; and each of said first and second substantially crescent shaped rigid supports being provided with an opening for removably receiving an upper end of said first and second posts, respectively.

6. A head support in accordance with claim 5 wherein said means for locking includes a pin adapted to be inserted through a hole in said rail and into a hole in said post.

7. A head support in accordance with claim 5 wherein said first and second posts are adapted to pass completely through the opening in said first and second support rail, respectively.

8. A head support in accordance with claim 1 wherein said substantially crescent shaped pad is comprised of a foam rubber material mounted to said rigid support and provided with a cover over the foam material.

9. A head support in accordance with claim 2 wherein said at least one opening for airflow is in the form of a tubular opening passing through said support.

10. A head support in accordance with claim 8 wherein each of said supports is provided with three openings in the form of tubular openings passing through each of said supports.

11. A head support in accordance with claim 8 wherein said tubular openings is a predetermined distance from a bottom of said rigid support.

12. A head support in accordance with claim 8 wherein said tubular opening slopes upwardly from an inner surface of said rigid support to an outer surface of said rigid support.

13. A head support in accordance with claim 1 wherein each of said first and second substantially crescent shaped rigid supports is provided with an opening for removeably receiving a post, and wherein a first and a second post is provided, said posts being adapted to be received in said first and second substantially crescent shaped rigid support opening for removeably receiving a post.

14. A head support in accordance with claim 1 further including:

a first and a second rail, said first and said second rail each being elongated with a first end and a second end;

a telescoping post comprised of a plurality of telescoping sections and being mounted to each of said first and second rails near a first end of each of said rails at a first end of said telescoping post;

each of said first and second substantially crescent shaped rigid supports being removeably mountable to a second end of each of said telescoping posts; and means for adjustably locking telescoping sections of said telescoping post to provide an adjustable length post wherein the height of said substantially crescent shaped rigid supports with respect to said rails may be adjustably locked.

15. A head support in accordance with claim 14 wherein said means for adjustably locking said telescoping sections is a threadable adjustment.

16. A head support in accordance with claim 15 wherein said threadable adjustment comprises threads formed on said telescoping sections wherein said telescoping sections may be rotated to adjust the length of the post.

17. A head support in accordance with claim 14 wherein said means for adjustably locking said telescoping sections is a friction lock.

18. A head support in accordance with claim 17 wherein said friction lock is engaged by a rotation of a telescoping section of less than a single revolution.

* * * * *